United States Patent [19]

Hatagishi

[11] Patent Number: 4,751,490

[45] Date of Patent: Jun. 14, 1988

[54] FUSE TERMINAL

[75] Inventor: Yuji Hatagishi, Gotenba, Japan

[73] Assignee: Yazaki Corporation, Tokyo, Japan

[21] Appl. No.: 29,239

[22] Filed: Mar. 23, 1987

[30] Foreign Application Priority Data

Apr. 18, 1986 [JP] Japan ..... 61-88260

[51] Int. Cl.[4] ..... H01H 85/04; H01H 85/10

[52] U.S. Cl. ..... 337/295; 337/166; 337/255; 337/290

[58] Field of Search ..... 337/295, 260, 255, 262, 337/264, 166, 290

[56] References Cited

U.S. PATENT DOCUMENTS 3,909,767 9/1975 Williamson et al. ..... 337/264
4,544,907 10/1985 Takano ..... 337/295
4,570,147 2/1986 Ebi ..... 337/295

OTHER PUBLICATIONS 58-163127 (Kokai) Laid-Open; Japanese Publication, 9/27/83.
59-41563 (Kokoku) Utility Model; Japanese Publication, 11/30/84.
60-6988 (Kokoku) Utility Model; Japanese Publication, 3/7/85.

*Primary Examiner*—H. Broome
*Attorney, Agent, or Firm*—Murray & Whisenhunt

[57] ABSTRACT

A fuse terminal comprising a fusible conductor formed of a Cu alloy having a conductivity of 20—less than 60% (IACS), the fusible conductor being formed with a narrow fuse portion at an intermediate position, and a pair of connection terminals formed at both ends of the fusible conductor and arranged in opposed relation with each other by bending the fusible conductor at both end portions thereof in a gantry fashion. The terminal is characterized by a surface area of the fusible conductor which is $\frac{1}{8}$-$\frac{1}{2}$ of that of the connection terminals.

2 Claims, 4 Drawing Sheets

FUSE TERMINAL

BACKGROUND OF THE INVENTION

The present invention relates to a fuse terminal (which will be also called a fusible link) for protecting a wire harness, and more particularly to a fuse terminal having an improved structure capable of attaining satisfactory fusing characteristics with use of a Cu alloy having a good spring performance and a conductivity of 20—less than 60% IACS.

Generally, the fusible link is fusible in a short time if an excess current flows in a circuit, thereby preventing damage to the wire harness and associated electrical equipment and also preventing a secondary accident such as burning. From the viewpoint of ease of handling, the fusible link usually comprises a fuse terminal having a fusible conductor with a fuse portion and connection terminals integrally formed with the fusible conductor.

An ideal fusing characteristic of the fusible link is shown in FIG. 4, using a motor of a 15 A rating current and a connection wire of AVS 1.25 sq ($mm^2$), for example.

A short-circuit is generally classified as a slight short-circuit or a dead short-circuit.

The dead short-circuit in case of AVS 1.25 is shown by a current waveform denoted by A in FIG. 4. Namely, the dead short-circuit is a short-circuit of such a kind where a relatively large current flows in the circuit. In designing an automotive wire harness, it can be generally sufficiently protected if the fusible link is fused within five seconds in case of such a large current. Drawing a dotted line Q corresponding to five seconds in parallel relation with an X-axis (current) and plotting an intersection P of the dotted line Q and the curved line A, a fusing characteristic curve of the fusible link must pass on the left side of the intersection P. However, a large current is instantaneously generated as shown by a curved line B upon starting of the motor. If the fusing characteristic curve is overlapped with the curved line B, the fusible link cannot effectively function. Accordingly, the fusing characteristic curve for the dead short-circuit must pass in a hatched region S, and especially from the viewpoint of durability, it must pass near the curved line A far away from the curved line B so as to lengthen the life of the harness.

On the other hand, the slight short-circuit is a short-circuit of relatively small current as generated in a region surrounded by T shown in FIG. 4. A curved line C denotes a smoking characteristic curve of AVS 1.25. If the fusing characteristic curve is overlapped with the curved line C, the fusible link cannot effectively function. Accordingly, the fusing characteristic curve of the fusible link for the slight short-circuit must pass in a cross hatched region S' where the fusing characteristic curve is not overlapped with the curved line C. However, if the fusing characteristic curve passes near the line of the rating current of 15 A, heat generation of the fusible link is increased upon supplying of the normal current of 15 A. Therefore, the fusing characteristic curve preferably passes near the curved line C far away from the line of 15 A.

For the above reasons, the ideal fusing characteristic is shown by a curved line D in FIG. 5.

As to the relation between the fusing characteristic and a material of the fusible conductor, it has been found that the fusing characteristic is classified into three kinds of curves E, F and G as shown in FIG. 6 in dependence upon a conductivity of the material. The relation between the curves and the conductivity is as follows:

| Curve | Conductivity (%) |
|---|---|
| E | 60 and more |
| F | 20–less than 60 |
| G | less than 20 |

The difference in the fusing characteristic curves E-G in dependence upon the conductivity is due to the following reasons. As a fusing time is instantaneous in case of a large current, the fusing characteristic depends on resistance, and temperature increase is rapid to reduce heat radiation performance. Accordingly, the samples of the fusible link are prepared to have the same resistance of the material, so as to make the dead short-circuit characteristics identical to one another. Therefore, the fusible link is made narrow in case of a high conductivity, while it is made wide in case of a low conductivity. This structure influences upon the heat radiation performance at the generation of the slight short-circuit. That is, temperature increase is gentle because of a small current, and the heat radiation characteristic largely influences upon the fusing characteristic. The lower is the conductivity, the greater is the width (surface area) of the material, enhancing the heat radiation performance, but reducing the fusing characteristic.

As is mentioned above, the fusible link having the ideal fusing characteristic may be produced by using a material having a conductivity of 60% and more. However, since such a material is inferior in spring performance, a fused terminal using the material as a spring material and having connection terminals formed integrally therewith is less reliable in electrical connection with a mating terminal. For example, a commercially available spring material has usually a conductivity of 30% or less. Although a spring material having a conductivity of about 50% and a good spring performance has been recently developed owing to an advanced technology, a conductivity of 60% has not yet been reached.

In a conventional fuse terminal as disclosed in Japanese Utility Model Publication No. 60-6988, a fusible conductor and a spring member (terminal portion) are formed of different materials. However, it is preferable to produce a fused terminal as an integral part from the viewpoint of a manufacturing cost. Further, a material having a conductivity of 65% has been proposed in Japanese Patent Laid-Open Publication No. 58-163127. However, unless the fusible conductor has a sufficient length, desired fusing characteristics cannot be obtained because of too high conductivity. As disclosed in Japanese Utility Model Publication No. 59-41563, it is required to make the fusible conductor (fuse portion) sufficiently long and seal a portion of the fusible conductor except the fuse portion by means of a heat absorbing member of an inorganic material so as to make up a lack of strength of the product. However, owing to a heat radiation effect of the heat absorbing member, a fusing characteristic is shown by the curved line F in FIG. 6. Further, the material disclosed in Japanese Patent Laid-Open Publication No. 58-163127 is known as a CDA 194 alloy having a spring limit value of about 23 kg f/mm$^2$, which does not satisfy a required value of 40 kg f/mm$^2$ for the spring member.

If the curved line F is intended to satisfy the slight short-circuit by increasing a resistance, it merely shifts to a curved line F', and is overlapped with the instantaneous current waveform of the motor (at a point P'). Accordingly, durability of the fuse terminal is reduced to result in no utility.

SUMMARY OF THE INVENTION

It is an object of the present invention to provide a fuse terminal which may satisfy both a fusing characteristic required by the fusible link and a spring performance required by the connection terminals to thereby improve a reliability of electrical connection.

It is another object of the present invention to provide a fuse terminal which may be produced in an integral configuration to thereby greatly reduce the manufacturing cost.

According to the present invention, there is provided a fuse terminal comprising a fusible conductor formed of a Cu alloy having a conductivity of 20—less than 60% IACS, the fusible conductor being formed with a narrow fuse portion at an intermediate position thereof, and a pair of connection terminals formed at both ends of the fusible conductor and arranged in opposed relation with each other by bending the fusible conductor at both end portions thereof in a gantry fashion. In other words, the fuse terminal takes a shape of such as a whole.

Other objects and features of the invention will be more fully understood from the following detailed description and appended claims when taken with the accompaning drawings.

DETAILED DESCRIPTION OF THE PREFERRED EMBODIMENT

Figure 1:
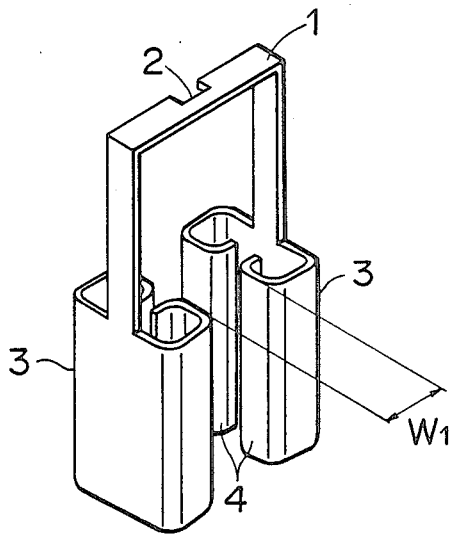
FIG. 1 is a perspective view of the fuse terminal of the present invention.

Referring to FIG. 1, the fuse terminal of the present invention comprises a fusible conductor 1 formed of a Cu alloy having a conductivity of 20—less than 60% IACS, the fusible conductor 1 being formed with a narrow fuse portion 2 at an intermediate position thereof, and a pair of connection terminals 3 formed at both ends of the fusible conductor 1 and arranged in opposed relation with each other by bending the fusible conductor 1 at both end portions thereof in a gantry fashion. A surface area of the fusible conductor 1 is set to range from $\frac{1}{8}$–$\frac{1}{2}$ of a surface area of the connection terminals 3.

A distance $W_1$ between the connection terminals 3 is preferably 2–6 mm. If the distance $W_1$ is less than 2 mm, heat generation upon supplying of power to the connection terminals 3 interferes with each other to accelerate an increase in temperature. If the distance $W_1$ is greater than 6 mm, the fuse terminal becomes larger in scale as a whole, which does not satisfy the requirements for making it compact.

Figure 2:
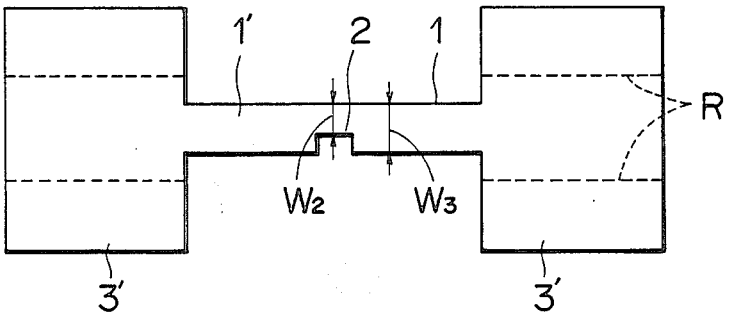
FIG. 2 is a development of the fuse terminal shown in FIG. 1.
Figure 3:
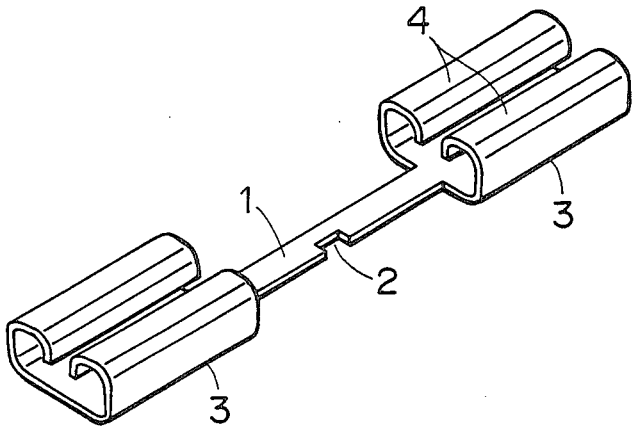
FIG. 3 is a perspective view of the fuse terminal in the middle stage of forming thereof.
Figure 4:
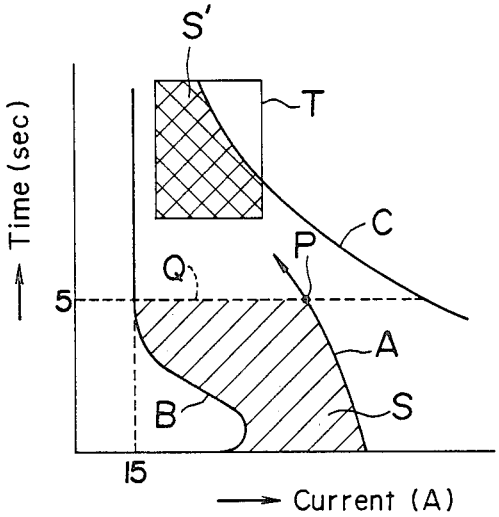
FIGS. 4 and 5 are graphs illustrating an ideal fusing characteristic of the fusible link.
Figure 5:
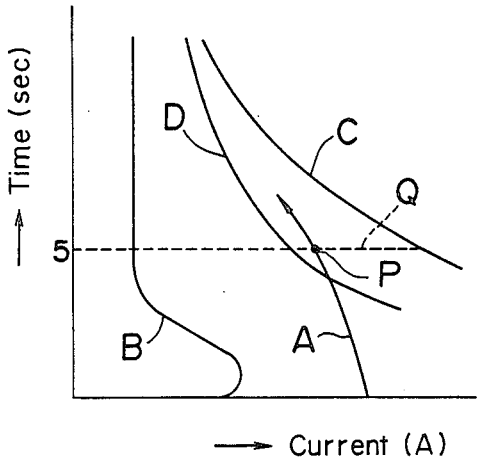
Figure 6:
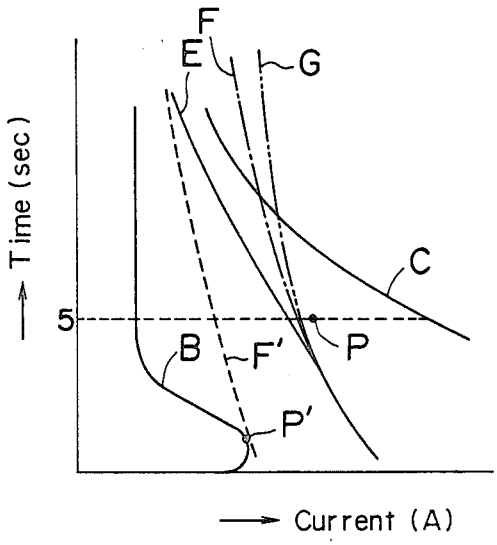
FIG. 6 is a graph illustrating different fusing characteristics due to difference in conductivity of materials of the fusible link.

FIG. 2 shows a development of the fuse terminal. The fuse terminal is formed by stamping a thin sheet metal of a Cu alloy (such as containing, for example, Cu balance, Sn 1.25, Fe 0.75 and P 0.03) having a conductivity of 20–60% IACS or less, and bending a pair of rectangular portions 3' formed on both sides inwardly from dotted lines R to form each pair of elastic holder arms 4 of the connection terminals 3 as shown in FIG. 3. A central narrow strip portion 1' formed between both the rectangular portions 3' corresponds to the fusible conductor 1 of the fused terminal. The surface area of the narrow strip portion 1' ranges from $\frac{1}{8}$–$\frac{1}{2}$ of the surface area of the rectangular portions 3'. After forming the elastic holder arms 4, the narrow strip portion 1' is bent at both sides in a gantry fashion. Thus, the fusible terminal is formed as shown in FIG. 1.

Figure 7:
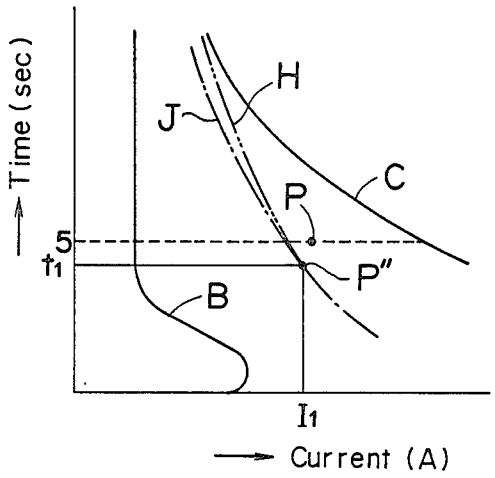
FIGS. 7 and 8 are graphs illustrating fusing characteristics of the fuse terminal according to the present invention.

The reason for limiting the surface area within the above-mentioned range is as follows:

Some samples of the fusible terminal as shown in FIG. 3 were prepared with use of a high-conductive material. One of the connection terminals 3 was pinched by an alligator clip leading from a battery, and the other is connected with a male terminal. Then, a current was supplied to the samples. In consideration of the aforementioned dead short-circuit, a resistance is regulated so that the samples may be fused at $t_1$ sec (point P'') upon supplying of current $I_1$ as shown in FIG. 7. As a method of regulating the resistance, the following two methods may be considered.

(1) Referring to FIG. 2, a width $W_2$ of the fuse portion 2 is narrowed with a width $W_3$ of the fusible conductor 1 made constant.

(2) The width $W_3$ of the fusible conductor 1 is narrowed with the width $W_2$ of the fuse portion 2 made constant.

Although it is naturally considered to take the size of the connection terminals 3 into account, there is not generated influence due to (1) and (2) with respect to a large current such as the dead short-circuit.

Then, using these samples, a short-circuit test was carried out to obtain a characteristic curve H for the sample (1) and a characteristic curve J for the sample (2) as shown in FIG. 7. Considering that such a difference between the characteristic curves is due to heat radiation performance, the surface area of the connection terminals 3 of the sample (1) is reduced to make the characteristic curve H coincident with the characteristic curve J.

It has been considered that the above phenomenon may be also applied to a Cu alloy having a good spring performance and a conductivity of 20–50% IACS. As the result of investigation, it has been found that an ideal fusing characteristic may be obtained by setting a ratio of the surface area of the fusible conductor 1 with respect to that of the connection terminals 3 to $\frac{1}{4}$–1. If the ratio is less than $\frac{1}{4}$, good heat radiation performance is obtained as shown by a curved line K in FIG. 8, but it is overlapped with the smoking characteristic curve C of AVS 1.25. If the ratio is greater than 1, heat radiation performance is reduced as shown by a curved line M. As the curved line M is located near the rating current of 15 A, heat generation upon supplying of the current of 15 A is increased. Thus, the range of $\frac{1}{4}$–1 has been determined in view of overlapping of the smoking characteristic of AVS 1.25 and heat generation upon supplying of 15 A current.

Actually, the fuse terminal has the form shown in FIG. 1, wherein both the connection terminals 3 are opposed to each other with the gap $W_1$ of 2–6 mm defined therebetween. Under such a structural limitation, the ratio of the surface area of the fusible conductor with respect to that of the connection terminals is preferably $\frac{1}{8}$–$\frac{1}{2}$, and the fusing characteristic in this case is shown by a curved line L in FIG. 8.

Figure 8:
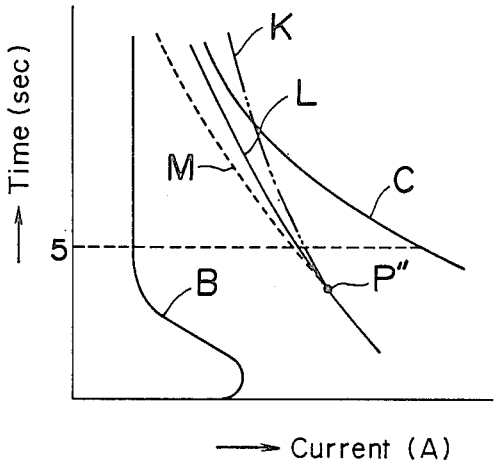

As is described above, the fuse terminal of the present invention has the fusing characteristic shown by the curved line L in FIG. 8. That is, the fusing characteristic satisfies the point P for the dead short-circuit, while it is not overlapped with the smoking characteristic curve C in the rating current region T for the slight short-circuit, and additionally, heat generation upon supplying of the rating current is reduced. This fusing characteristic is achieved by using a Cu alloy having a good spring performance and a conductivity of 20—less than 60% IACS. Accordingly, the fuse terminal is greatly satisfactory as a fuse terminal comprising a fusible conductor and connection terminals integrally formed therewith, and may provide a high reliability of electrical connection.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A fuse terminal, comprising:

a fusible conductor formed of a Cu alloy having a conductivity of 20 to less than 60% IACS, said fusible conductor having end portions and being formed with a narrow fuse portion at an intermediate position; and a pair of connection terminals formed at both ends of said fusible conductor and arranged in opposed relation with respect to each other by bending said fusible conductor at both said end portions thereof in a shape of a gantry, said fusible conductor having a surface area $\frac{1}{8}$–$\frac{1}{2}$ of that of said connection terminals.

2. The fuse terminal as claimed in claim 1, wherein said opposed connection terminals are separated by distance of 2–6 mm.

* * * * *